US012338731B2

(12) United States Patent
Al-Rubaii

(10) Patent No.: US 12,338,731 B2
(45) Date of Patent: Jun. 24, 2025

(54) REAL-TIME MEASUREMENTS OF PHYSICAL PROPERTIES OF DRILLED ROCK FORMATIONS DURING DRILLING OPERATIONS

(71) Applicant: Saudi Arabian Oil Company, Dhahran (SA)

(72) Inventor: Mohammed Murif Hassan Al-Rubaii, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 394 days.

(21) Appl. No.: 17/959,093

(22) Filed: Oct. 3, 2022

(65) Prior Publication Data

US 2024/0117734 A1 Apr. 11, 2024

(51) Int. Cl.
*E21B 49/00* (2006.01)
*E21B 44/00* (2006.01)

(52) U.S. Cl.
CPC ..... *E21B 49/005* (2013.01); *E21B 44/00* (2013.01); *E21B 49/003* (2013.01); *E21B 2200/20* (2020.05)

(58) Field of Classification Search
CPC ..... E21B 49/005; E21B 44/00; E21B 49/003; E21B 2200/20
See application file for complete search history.

(56) References Cited

U.S. PATENT DOCUMENTS

2020/0371495 A1* 11/2020 Al-Rubaii ..... G05B 9/00
2021/0171406 A1 6/2021 Singh et al.
2022/0251950 A1* 8/2022 Al-Malki ..... E21B 49/003
2022/0381130 A1* 12/2022 Chen ..... E21B 44/00
2023/0304391 A1* 9/2023 Sheng ..... E21B 25/00
2023/0324579 A1* 10/2023 Shao ..... G01V 3/34 324/346

OTHER PUBLICATIONS

Ramiah, Kalidhasen, and et al. "A 2D geomechanical model of an offshore gas field in the Bredasdorp Basin, South Africa." Journal of Petroleum Exploration and Production Technology 9 (2019): 207-222 (Year: 2019).*

(Continued)

*Primary Examiner* — Douglas Kay
(74) *Attorney, Agent, or Firm* — Fish & Richardson P.C.

(57) ABSTRACT

Systems and methods include a method for determining drilling information. A cutting concentration in annulus (CCA) is determined while drilling a well using drilling parameters and mud properties. An effective mud weight of mud and an equivalent circulating density (ECD) of mud used in the well are determined. A bulk formation rock density (RHOB) of cuttings from the well is estimated using the ECD, a bulk density model, and a bulk density log, where the cuttings are produced by drilling the well through rock formations. A fluid formation density (RHOF) and a mud matrix formation rock density (RHOM) for the well are estimated. A porosity of geological structures through which the well is drilled and a formation resistivity factor (FR) of formations are estimated. A velocity of wave propagation of waves through the formations is evaluated. An ultimate compressive strength (UCS) is estimated for the well.

20 Claims, 5 Drawing Sheets

(56) References Cited

OTHER PUBLICATIONS

Anbazhagan, P., and et al. "Correlation of densities with shear wave velocities and Spt N values." Journal of Geophysics and Engineering 13, No. 3 (2016): 320-341 (Year: 2016).*

Awang, H., NR Ahmad Rashidi, M. Yusof, and K. Mohammad. "Correlation between P-wave velocity and strength index for shale to predict uniaxial compressive strength value." In MATEC Web of Conferences, vol. 103, p. 07017. EDP Sciences, 2017 (Year: 2017).*

Ellis, "Formation Porosity Estimation from Density Logs," Petrophysics, Sep. 2003, 44(05), Abstract only, 6 pages.

Gates, "Estimating the Unconfined Compressive Strength of Vesicular Basalts via Bulk Specific Gravity of the Rock Sample," ARMA-08-131, OnePetro, Paper presented at The 42nd U.S. Rock Mechanics Symposium (USRMS), San Francisco, California, Jun. 2008, Abstract only, 6 pages.

Holenka et al., "Azimuthal porosity while drilling," SPWLA-1995-BB, In SPWLA 36th Annual Logging Symposium, Society of Petrophysicists and Well-Log Analysts, Jun. 1995, Abstract only, 6 pages.

Li, "Density Anomaly Indicators And Application," SEG-2006-0299, OnePetro, Paper presented at the 2006 SEG Annual Meeting, New Orleans, Louisiana, Oct. 2006, 6 pages.

Oluyemi et al., "Real Time Continuous Reservoir Strength Prediction from Grain Size Distribution Information Using Neural Network," SPE-105960-MS, OnePetro, Paper presented at the Nigeria Annual International Conference and Exhibition, Abuja, Nigeria, Jul. 2006, 9 pages.

Spross et al., "Formation Density Measurement While Drilling," SPWLA-1993-PP, In SPWLA 34th Annual Logging Symposium, Society of Petrophysicists and Well-Log Analysts, Jun. 1993, Abstract only, 6 pages.

* cited by examiner

REAL-TIME MEASUREMENTS OF PHYSICAL PROPERTIES OF DRILLED ROCK FORMATIONS DURING DRILLING OPERATIONS

TECHNICAL FIELD

The present disclosure applies to improvements in drilling operations, such as for oil wells.

BACKGROUND

When wells, such as oil wells, are drilled, the drilling operations can be affected by many factors. For example, the drilling equipment being used and how the equipment is used (e.g., including drill bit speed and direction) can determine how fast and efficient the drilling process may be. Information gained from downhole temperature and pressure sensors can also be used. Moreover, the geological formations, such as types of rock, can also affect the drilling operations. Drilling teams, e.g., including petroleum engineers, can benefit from having knowledge of the drilling parameters being used and the conditions encountered while drilling. Information that is available can allow drilling teams to make changes in the drilling operations.

SUMMARY

The present disclosure describes techniques that can be used for improving drilling operations using real-time measurements of physical properties of drilled rock formations during drilling operations. In some implementations, a computer-implemented method includes the following. A cutting concentration in annulus (CCA) is determined for a gas or oil well using drilling parameters and mud properties while drilling the well. An effective mud weight of mud used while drilling the well is determined based at least on the CCA. An equivalent circulating density (ECD) of mud used in the well is determined based at least on the effective mud weight and the mud properties of the well. A bulk formation rock density (RHOB) of cuttings from the well is estimated using the ECD, a bulk density model, and a bulk density log, where the cuttings are produced by drilling the well through rock formations. A fluid formation density (RHOF) of the mud is estimated based at least on the RHOB. A matrix formation rock density (RHOM) for the well is estimated based at least on the RHOB and the RHOF. A porosity of geological structures through which the well is drilled is evaluated based at least on the RHOB, the RHOM, and the RHOF. A formation resistivity factor (FR) of formations, including geological structures through which the well is drilled, is estimated based at least on the porosity. A velocity of wave propagation of waves through the formations is evaluated based at least on the RHOB. An ultimate compressive strength (UCS) is estimated for the well using a correlation of the bulk density model and the velocity of wave propagation.

The previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. A real-time model for the evaluation of rock properties can be developed and used. Stuck pipe incidents due to bad hole cleaning can be minimized. Drilling rates can be improved. Non-productive times can be minimized. Logging times can be minimized. Better well design can occur. Drilling efficiency can be improved. Functionality of existing logging tools can be replaced through the use of the techniques of the present disclosure. Drilling scenarios can be optimized. For example, optimizing drilling scenarios can refer to achieving drilling and rig efficiency values that indicate or result in a performance greater than a predefined threshold. Problems that occur while drilling can be minimized. Real-time cuttings can be monitored and evaluated. The real-time models of the present disclosure can enable drilling teams to drill holes safely and optimally without inducing any problems. This can ensure smooth and proper optimized drilling and rig efficiency. Formation types and lithology can be determined using grain density and matrix density, which can replace the need for mud logging units in drilling rigs that are assigned for development fields drilling operations. Physical properties can be estimated from drilling surfaces in real-time using limited numbers of sensors without using external drilling tools. Physical properties can be estimated using developed models. Real-time profiles can be generated and viewed immediately. The others physical properties can be calculated and estimated fundamentally from equations described in the present disclosure.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1:
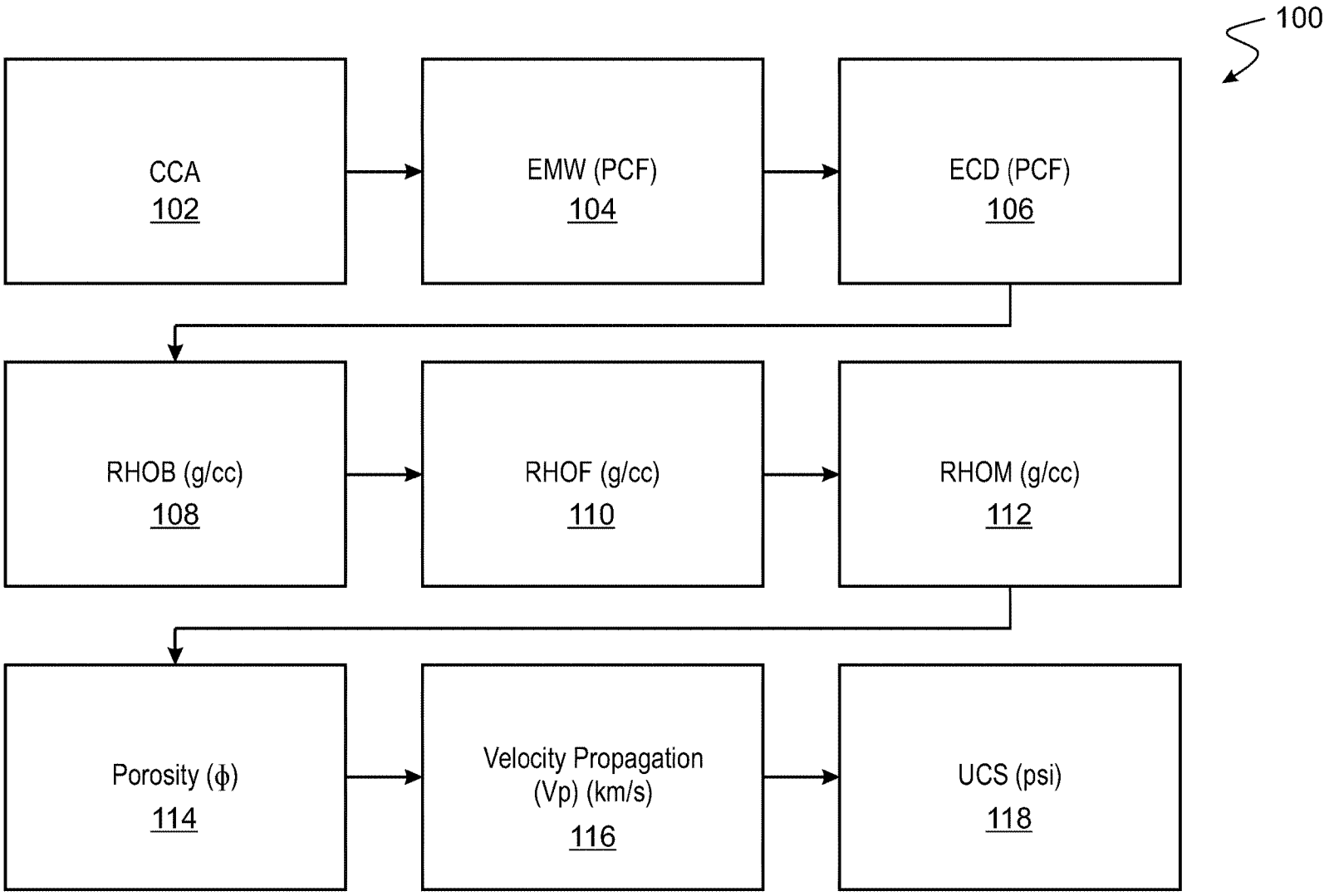
FIG. 1 is a flowchart of a workflow for making physical rock properties applicable for evaluating a drilled hole section, according to some implementations of the present disclosure.

The following detailed description describes techniques for improving drilling operations by using real-time measurements of physical properties of drilled rock formations during drilling operations. Various modifications, alterations, and permutations of the disclosed implementations can be made, and will be readily apparent to those of ordinary skill in the art, and the general principles defined may be applied to other implementations and applications, without departing from the scope of the disclosure. In some instances, details unnecessary to obtain an understanding of the described subject matter may be omitted so as to not obscure one or more described implementations with unnecessary detail and such details are within the skill of one of ordinary skill in the art. The present disclosure is not intended to be limited to the described or illustrated implementations, but to be accorded the widest scope consistent with the described principles and features.

The techniques of the present disclosure can include the development of real-time algorithms based on data mining-based physical model techniques that can be applied to enhance well drilling and rig performance. The techniques can include the use of real-time models for monitoring physical rock formation properties during drilling operations. The developed models can use real-time algorithmic equations used to evaluate bulk density, grain density, porosity, formation pressure, formation resistivity factor, overburden pressure, and ultimate compressive strength profile in real-time. The models can allow drilling teams to continuously monitor, evaluate, and advise physical properties of drilled formations influenced during drilling operations to optimize well drilling and rig performance, and to reduce non-rotating time. Systems using the techniques of the present disclosure can utilize surface rig sensors and mud rheological properties to interpret downhole measurements and conditions by using developed real-time models. The models can consider drilling fluids density, rheology, and drilling rates with other rig sensors. This can serve as an input in addition to general well data to provide a display of physical rock properties as a real-time curve for the drilling team's assessment and intervention. The real-time algorithmic model can provide drilling teams with continuous monitoring, evaluation, and optimization regarding drilling operations performance and efficiency for use in planning phases. This can help to mitigate hole problems and improve drilling rig performances resulting in safer and more economical wells optimizations. Physical rock properties can be evaluated and deployed as real-time monitoring from a real-time operating center. Field tests can be conducted on multiple drilling wells to practically validate the effectiveness of real-time models.

A real-time model of the present disclosure can be developed by using a real-time, data-driven approach that also includes the sense of physics. The real-time algorithmic model was developed by collecting data, then developing and evaluating models which were then validated using fields operations. The developed algorithms were based on data mining and based physical models techniques that can be applied to show real-time profiles for rock formation physical properties. The models allow the drilling team to continuously monitor, evaluate, and provide suggestions for actions to improve efficiency while drilling. The actions can be taken to avoid excessive drilling time, non-rotating time, and hole problems, and to help optimize well drilling and rig performance. Information made available by executing the models can allow for immediate intervention when wellbore drilling performance is inefficient, such as to provide changes (e.g., in drilling parameters) that lead to optimization and drilling formation effectiveness. The techniques can lead to enhanced evaluation of rock physical properties while drilling, which can lead to reduced logging runs and can provide clear insights about drilled zones.

The evaluation of rock formation physical properties, including drilling rates, can ensure optimum performance for rig and drilling efficiency. These actions can mitigate drilling troubles associated with stuck pipe incidents and excessive drilling costs. Use of the techniques can minimize non-rotating time, maximize the rate of penetration (ROP), and improve hole cleaning efficiency by optimizing the mechanical drilling parameters, e.g., revolutions per minute (RPM). Use of the techniques can also improve weight on bit (WOB), pumping rate or gallons per minute (GPM), torque on bit, standpipe pressure (SPP), and rheological chemical and physical drilling fluids properties. As long as the cuttings concentration loaded in annulus is below a threshold (e.g., less than 0.05), the workflow described in the present disclosure can be used to determine an optimized ROP in conjunction with a minimized non-drilling time. This can yield ideal real-time profiles of rock physical properties values integrated with developed rock formation models, and thereby reducing the drilled cost-per-foot. The developed methodology can assist drilling engineers in selecting improved drilling scenarios. Evidence of improved efficiencies can result from comparisons of rock physical properties and logging tool values and experiments fields validations for a vertical, deviated, and horizontal hole sections that are drilled, e.g., for offset wells drilled in a non-optimized fashion.

Automated evaluation of physical properties of rock can meet the requirements (or align with) the fourth industrial revolution (4IR), e.g., as a digital twin bridging physics and well data. This can ensure optimization of well design, such as casing design, drilling string design, mud windows, bit selection, and improved well drilling performance. In the area of optimized production, flow rates can be enhanced. This can lead to reduced sand production, reduced drawdown pressure, and reduced washout length of propagation of proponent fluid, hydraulic fracturing and hole section washout. The techniques can also lead to improvements in controlling reservoir description, well design, and production optimization. This can save time, reduce costs, and deliver wells in a more optimized timeframe, with higher quality, improved safety, and more efficient reservoir management.

During the performance of drilling operations, wire line logging operations can be used to evaluate certain drilled hole sections. The operations can include acquiring data such as porosity, formation pressure and leak off test (LOT) to estimate fracture pressure and formation fluid content. Automated physical rock properties while drilling can minimize usage of planned logging operations and improve the efficiency of running certain tools such as pressures while drilling (PWD) and formation tester tools (FTT).

Evaluation of bulk density while drilling can help to estimate overburden pressures of drilled formations. If the limit of overburden pressure is high, this can mean that the fracture pressure limit is high. In this case, the drilling team can decide whether to increase drilling performance to a certain limit before a fracture pressure boundary is encountered. This can result in improving safety factors associated with preventing lost circulation incident due to generated drilling cuttings weight while drilling, e.g., that is added to used drilling fluid weight while drilling. Bulk density can be used to estimate grain density of drilled rock. Then, the drilling team can evaluate formation lithology to recognize formation tops that are planned to be casing points for landing casing. In addition, formations can be avoided that have problematic wellbore instability, making it possible to realize one or both of optimized mud rheology and drilling parameters.

Previously-described techniques can be used to effectively optimize well operations performance. On the other hand, evaluating porosity while drilling can provide information about shale contents in drilled formations, including identifying immediate intervention that can be taken to optimize drilling fluid formula and add required additives to stabilize formations, e.g., in the case of reactive shale. Evaluating porosity while drilling can also improve the evaluation of other types of porosity with respect to movable fluid contents.

When a drilling team evaluates porosity while drilling, the team can use tools to more accurately estimate formation pore pressure. Doing so can allow the drilling team to readjust the previously-used assumed value in a next planned well to have better well drilling performance and to avoid hole problems. Evaluating porosity while drilling can lead to estimating porosity in deeper hole sections and reservoirs as well. This will save time and costs associated with runnable tools that otherwise would be used to estimate porosity. Formation resistivity factor can also make it possible to estimate fluid content of drilled formation. Doing so can improve the ability to evaluate drilled wells to optimize well placement and avoid drilling dried hole sections or wells through designated zones of fields.

Evaluating ultimate compressive strength (UCS) (e.g., in megaPascals (Mpa)) while drilling can make it possible to estimate elastic parameters of drilled rock such as Young's modulus and Poisson's ratio. Then, stress can be estimated to ensure an optimum mud window by designing proper boundaries such as pore pressure limit, fracture pressure limit, vertical stress, minimum horizontal stress and maximum horizontal stress. Other information can be estimated such as wash out, break out, and stress regimes to avoid faults and folds. Doing so can add value to geological engineering as well. Data that is collected can be used to enhance reservoir descriptions, drilling operations, and production flow rates. Physical rock properties can be evaluated by using surface drilling parameters and mud rheological properties. The data can be analyzed to determine the bulk density of rock of surface mud properties and drilling parameters from the effects of ROP and cuttings volume or cuttings concentration in annulus in certain hole sections. This can show the effects of mud rheological properties and drilling hydraulics. Tables 1 shows examples of drilling parameters:

TABLE 1

Drilling Parameters and Mud Rheology from Collected Data.

| Items | Terms | Parameters | Acronyms | Units |
|---|---|---|---|---|
| 1 | Pumping Rate | Drilling | | Gallons/minute (GPM) |
| 2 | Mud Weight | Rheology | MW | Pounds per gallon (PPG) or pounds per cubic foot (PCF) |
| 3 | Plastic Viscosity | Rheology | PV | CP |
| 4 | Yield Point | Rheology | YP | $\frac{lb}{100}$ $ft^2$ |

TABLE 2

Calculated Drilling Parameters, Mud Rheology Parameters, and Hole Cleaning Indicators.

| Items | Terms | Parameters | Acronyms | Units |
|---|---|---|---|---|
| 1 | Equivalent Circulating Density | Hydraulic | ECD | PPG or PCF |
| 2 | Drilling Rate | Drilling | ROP | Feet/hour |
| 3 | Transport Ratio | Hole Cleaning Indicator | TR | % |
| 4 | Cutting Concentration in Annulus | Hole Cleaning Indicator | CCA | % |

Bulk Density Model

The purposes of determining bulk density include allowing drilling engineers to use ROP in a well to evaluate physical properties of drilled hole sections. The ROP can be utilized in order to calculate effective mud weight while drilling by using generated cuttings concentration in annulus (CCA) and calculating ECD by using the effective mud weight and mud properties. Bulk density can then be estimated and compared with a bulk density log to validate the result and verify the applicability of using drilling automation in real-time. Other physical rock properties can be estimated by using best results.

FIG. 1 is a flowchart of a workflow 100 for making physical rock properties applicable for evaluating a drilled hole section, according to some implementations of the present disclosure. At 102, CCA is calculated while drilling. At 104, effective mud weight is calculated while drilling by using CCA. At 106, ECD is calculated by using effective mud weight and mud properties. At 108, bulk density, or bulk formation rock density (RHOB), is estimated by using developed bulk density model that is compared with bulk density log. At 110, density of fluid, or fluid, is estimated formation density (RHOF). At 112, grain density, or matrix formation rock density (RHOM), is estimated using bulk density and pore fluid density.

At 114, porosity is estimated by using bulk density, grain density, and fluid density. Formation resistivity factor (FR) is estimated. At 116, velocity of propagation (is compressional velocity) is evaluated. At 118, UCS is estimated.

During experimentation and testing, the model of bulk density was compared with bulk density of a deviated hole section having an interval length 2000 feet. The results showed that the average absolute error between values of calculated bulk density by using the model and bulk density log was less than 2%.

The results show that the ROP has strong relationship with bulk density, grain density, pore fluid density, porosity, formation resistivity factor, velocity propagation and UCS. All other physical properties were calculated based on the validation of bulk density model compared with bulk density log. These results of these real-time developed models were compared with results of graphs of porosity with UCS, grain density with real grain density of drilled formation, and porosity with formation resistivity factor. Calculation of CCA have shown effective mud weight as real-time and guide us to determine the ECD limit by using measured the rate of penetration. The CCA and ROP has a strong direct relationship with effective mud weight while drilling. Drilling rate or rate penetration has strong relationship with calculated ECD that was calculated by using effective and mud properties such as plastic viscosity (PV) and yield point (YP). ECD will increase as ROP increases due to more drilling cuttings generated while drilling, and an added amount of cuttings in the drilling fluid weight. Bulk density was calculated by using the developed model and was compared with bulk density logs. The result of validation was outstanding with having absolute average error was less than 2%.

The model results indicate that the model can estimate overburden gradient (OBG) based on calculated bulk density. The rate of penetration can provide guidance about fluid density of a drilled formation by using de-exponent and modified de-exponent methods. However, usage of de-exponents may have limited applications. On the other hand, ROP was plotted with the calculated fluid density of a drilled formation based on a developed bulk model density to estimate pore fluid density. The plot also showed a strong correlating relationship between the values.

During model development and testing, after the estimation of pore fluid density was made, grain density was estimated to show the relation between ROP and grain (or drilled formation density or matrix density). ROP can explain and be used to evaluate porosity while drilling, especially total porosity which can be calculated after estimating grain density of drilled formation. ROP can be plotted with porosity. The formation resistivity factor can be estimated to evaluate drilled formation fluids content and cementation factor. UCS can be calculated by using the bulk density model and a velocity of propagation correlation. Automated UCS can be calculated based on bulk density, with an automated porosity calculation based on a developed bulk density model. In addition, FR can be plotted with porosity.

Plots can be created that include various combinations of automated bulk density, grain density, porosity, formation resistivity (FR), and UCS. Automated physical rock properties can ensure the performance optimization of drilling and workover operations. After developing the bulk density model, best applied models of VP and UCS can be used to make or develop a new trend of automated UCS as real-time data. After completing this work, the bulk density model can serve as an effective tool to ensure optimized automated evaluation processes of physical properties while drilling. Surface drilling fluid properties and drilling parameters can be used to develop the bulk density model. The model can be applied in all challenging hole sections with different drilling parameters and mud systems. The real-time values of automated evaluation while drilling down hole can provide a better application of physical rock properties. The developed RHOB model with respect of drilling parameters and mud rheological properties can be more realistic than other correlations. This occurs because the other correlations that have parameters of mud rheology are qualitative relationships only. The model can be an effective tool for a drilling engineering team and operator company to ensure proper well operations performance, and to minimize non-productive times associated with running tool failures. Applying the model can reduce flat time by providing an automated process while drilling rather than relying on the usage of manual tools. The model can be used to improve efficiency in well operation performance, including improving cost effectiveness and contributing to well delivery.

Figure 2:
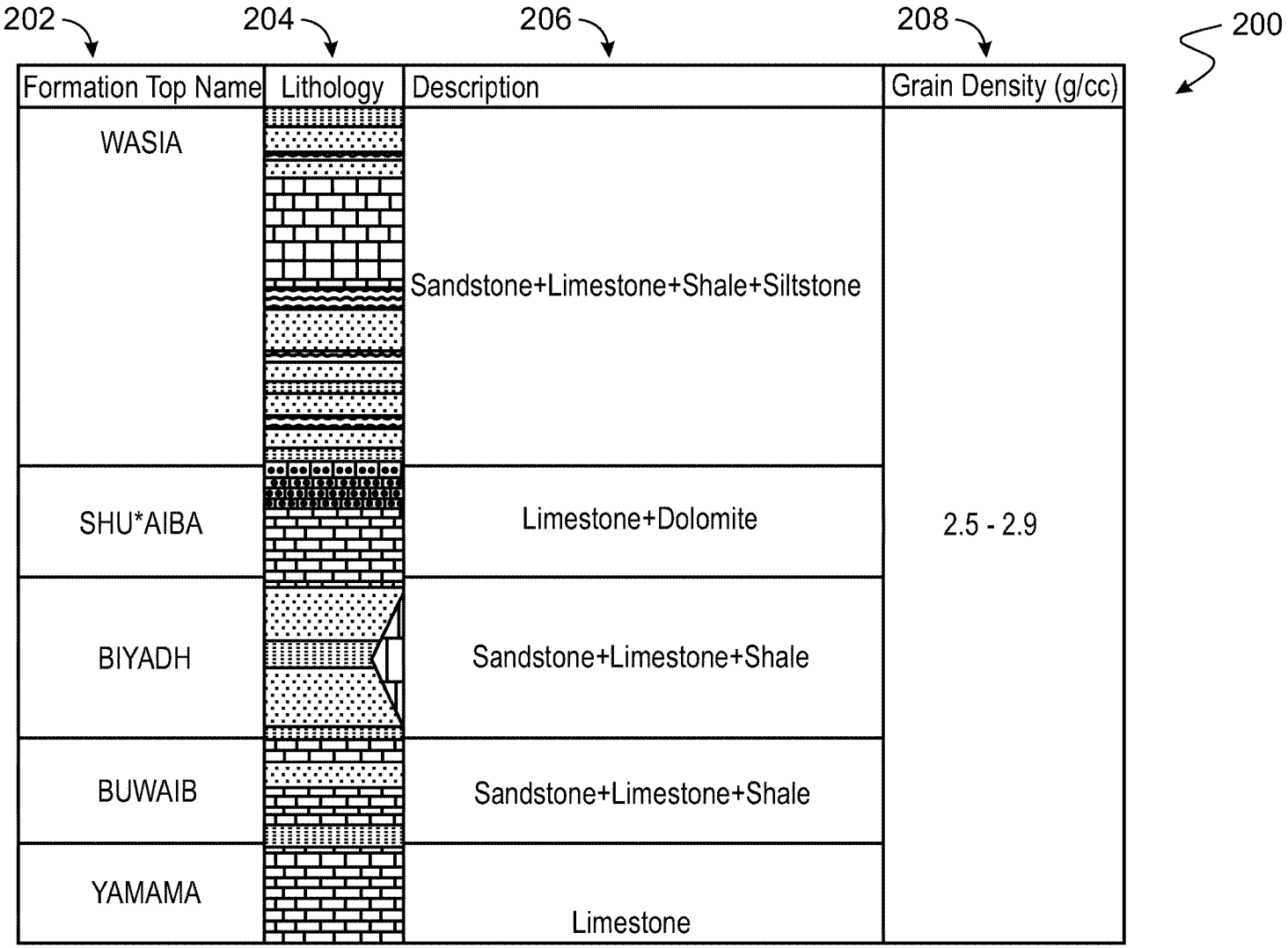
FIG. 2 is a table showing examples of formation types and corresponding features for a given grain density range, according to some implementations of the present disclosure.

FIG. 2 is a table 200 showing examples of formation types 202 and corresponding features for a given grain density range, according to some implementations of the present disclosure. For example, the features include a lithology 204, a description 206, and a grain density 208 (e.g., a range of 2.5-2.9 grams per cubic centimeter (g/cc)).

Figure 3:
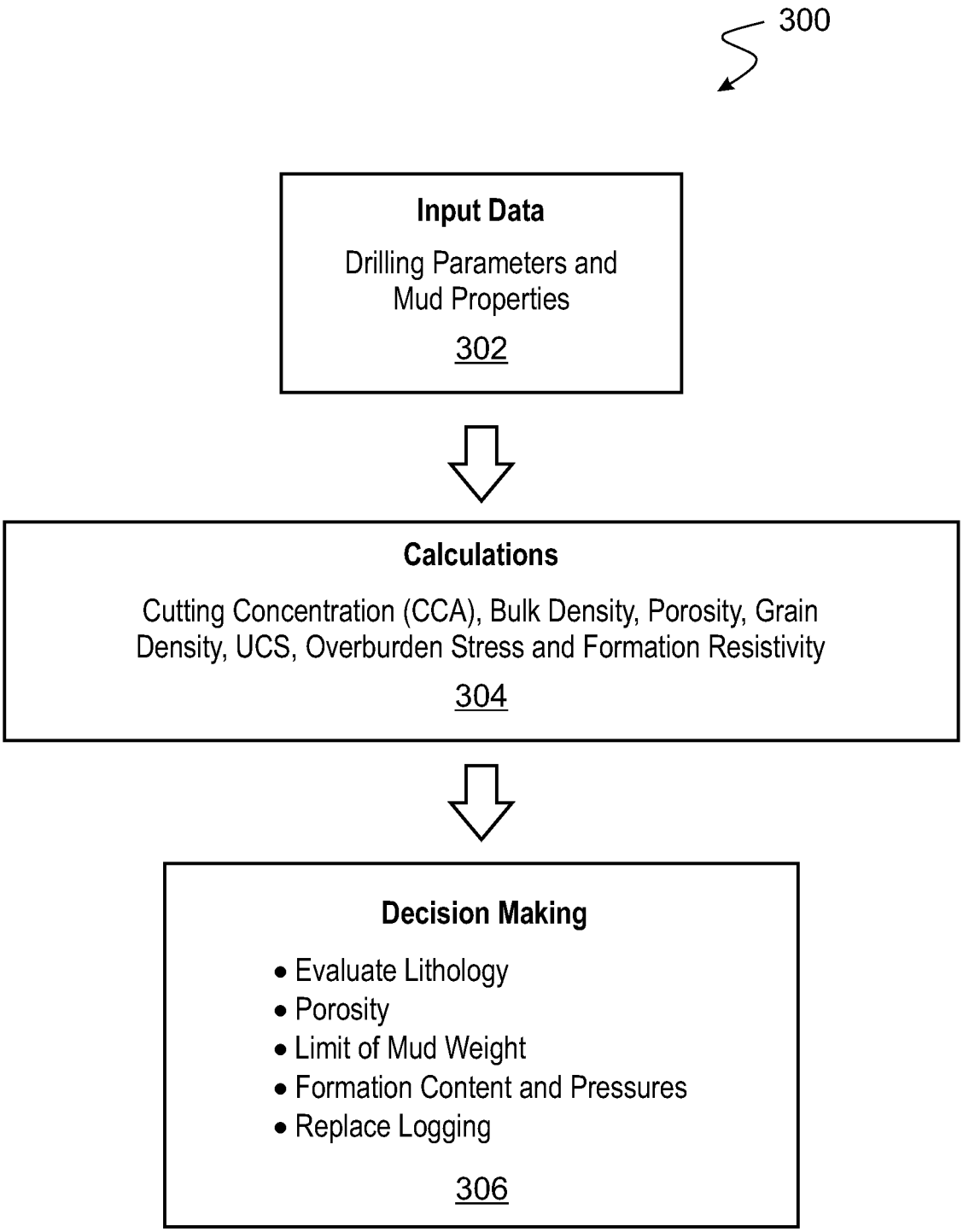
FIG. 3 is a flow chart showing an example workflow for determining information and decision making.

FIG. 3 is a flow chart showing an example workflow 300 for determining information and decision making. The detailed calculations of physical rock properties can be summarized as follows. Input data 302 (e.g., defining drilling parameters and mud properties) can include, for example, ROP, GPM, hole size, mud density (in PCF and ppg), depth, YP, and PV. Preliminary calculations 304 that occur before an evaluation can include determining parameters such as, cuttings concentration, effective mud weight, ECD, bulk density, D-exponents, modified D-exponents, pore pressure, overburden stress, velocity propagation, UCS, grain density, porosity, formation resistivity, and formation pressures. Model calculations and decision making 306 can include determine the physical properties of rock while drilling using the following models: 1) a lithology method for evaluating formation types and grain densities, 2) a porosity method for evaluating porosity, 3) a formation resistivity method for evaluating formation contents during drilling and cementation, and 4) a formation pressures method for evaluating formation pressures while drilling and to determine optimum mud windows to minimize drilling problems.

Equations

The following equations can be used in support of the techniques described in the present disclosure. The effective mud weight (EMW), e.g., in PCF, can be given by:

$$\text{EMW (PCF)}=(\text{CCA}*\text{MW}+\text{MW}) \tag{1}$$

ECD can be given by:

$$ECD = \frac{EMW}{8.33} + \left(\frac{0.1}{(OG - DP)} \times \left(YP + \frac{PV \times AV}{300 \times (OH - DP)}\right)\right) \tag{2}$$

CCA can be given by:

$$CCA\ \% = \left(-0.5 * \left(\frac{Vann_{vertical}}{V_s} - 1\right) + + \left(0.25 * \left(\frac{Vann_{vertical}}{V_s} - 1\right)^2 + \left(\frac{Vann_{vertical}}{V_s}\right) * V_c / \left(\frac{GPM}{7.48}\right)\right)^{0.5}\right) * 100 \tag{3}$$

where the annular velocity (Vann) vertical can be given by:

$$Vann_{vertical} = \frac{24.5 * GPM}{\text{Hole size}^2 - OD_{pipe}^2} \tag{4}$$

where:

$$V_s = \frac{\dfrac{60}{\left(1 - \left(\dfrac{OD_{pipe}}{\text{Hole size}}\right)^2\right) * \left(0.64 + \dfrac{18.16}{ROP}\right)} + \dfrac{12.25\ GPM}{\text{Hole size}^2 - OD_{pipe}^2}}{2} \cos(HA) + \frac{\dfrac{60}{\left(1 - \left(\dfrac{OD_{pipe}}{\text{Hole size}}\right)^2\right) * \left(0.64 + \dfrac{18.16}{ROP}\right)} + \dfrac{12.25\ GPM}{\text{Hole size}^2 - OD_{pipe}^2}}{2} \sin(HA) \tag{5}$$

and where:

$$V_c = \left(\frac{ROP}{60}\right) * \text{Cos}\ (HA) + \left(\frac{ROP}{60}\right) \sin(HA) \tag{6}$$

Bulk density can be calculated as:

$$\text{Bulk density } (RHOb)(PPG) = \frac{(cca \times \text{MW} + \text{MW}) + (1 - cca)Mw)}{8.333} \text{ A New Model} \tag{7}$$

D-Exponent can be calculated as:

$$de = \frac{\log\left(\frac{ROP}{60\ RPM}\right)}{\log\left(\frac{12WOH * 1000}{1000000\ OH}\right)} \tag{8}$$

Modified D-exponent can be calculated as:

$$dm = de\frac{EMW}{ECD} \tag{9}$$

Pore pressure (PP) can be calculated as:

$$pp\left(\frac{\text{psi}}{\text{ft}}\right) = 0.46\ \frac{de}{dm} \tag{10}$$

Overburden gradient can be calculated as:

$$sig\ ov\ or\ (OBP)\left(\frac{\text{psi}}{\text{ft}}\right) = \frac{\text{bulk density } (8.34)(\text{depth}) * 0.052}{\text{depth}} \tag{11}$$

Modified pore pressure (MPP) can be calculated as:

$$MPP\left(\frac{\text{psi}}{\text{ft}}\right) = pp - \left(pp - \left((sig\ ov - 0.46)\left(\frac{dm}{de}\right)^{1.2}\right)\right) \tag{12}$$

Velocity of wave propagation (Vp) can be calculated as:

$$Vp\left(\frac{\text{km}}{\text{s}}\right) = \left(\frac{1.74}{\text{bulk density}}\right)^{3.9} \tag{13}$$

Ultimate compressive Strength (UCS) can be calculated as:

$$UCS\ (Mpa) = \frac{35}{Vp} - 30 \tag{14}$$

Fluid density (e.g., in g/cc) can be calculated as:

$$\text{Fluid density}\left(\frac{\text{g}}{\text{cc}}\right) = MPP/0.433 * 0.7 \tag{15}$$

Grain density (Gd or RHOM or RHO matrix) (e.g., in g/cc) can be calculated as:

$$HOm\ (\text{g/cc}) = \text{Fluid density}\left(\frac{\text{g}}{\text{cc}}\right) * 0.8 + \text{bulk density}\left(\frac{\text{g}}{\text{cc}}\right) \tag{16}$$

Porosity (Por) can be calculated as:

$$Por = -0.431\ \ln\left(\frac{UCS}{143.8}\right) \tag{17}$$

Formation resistivity (FR), e.g., in ohms, can be calculated as:

$$\text{FR (Ohm)}=1/(\text{Por}^2) \tag{18}$$

Formation Pore Pressure (FPP), e.g., in PSI, can be calculated as:

$$FPP = 8.34 * \text{Fluid density}\left(\frac{\text{g}}{\text{cc}}\right) * 0.052 * \text{depth (ft)} \tag{19}$$

Fracture Formation Pressure (FFP), e.g., in PSI, can be calculated as:

$$\text{FFP}=(((0.3*\text{sig } ov+0.75*\text{Fluid density (g/cc)}*0.433)+(0.5*\text{sig } ov+0.5*\text{Fluid density (g/cc)}*0.433)+\text{Fluid density (g/cc)}*0.433+0.42*(\text{sig } ov-\text{Fluid density (g/cc)}*0.433))/2)*\text{depth (ft)} \tag{20}$$

Hydrostatic pressure (HSP), e.g., in PSI, can be calculated as:

$$\text{HSP(psi)=EMW (PCF)}*0.007*\text{depth (ft)} \tag{21}$$

Bottom Hole Circulating Pressure (BHCP), e.g., in PSI, can be calculated as:

$$\text{BHCP (psi)=ECD (PCF)}*0.007*\text{depth (ft)}+0.15*\text{SPP (psi)} \tag{22}$$

Overburden pressure (OBP), e.g., in PSI, can be calculated as:

$$\text{OBP (psi)=sig } ov*\text{depth (ft)} \tag{23}$$

Drilling cuttings WC (PPG), e.g., in PSI, can be calculated as:

$$Wc(\text{PPG})=\text{MW (1+CCA)}+(1-\text{CCA})\text{MW} \tag{24}$$

Figure 4:
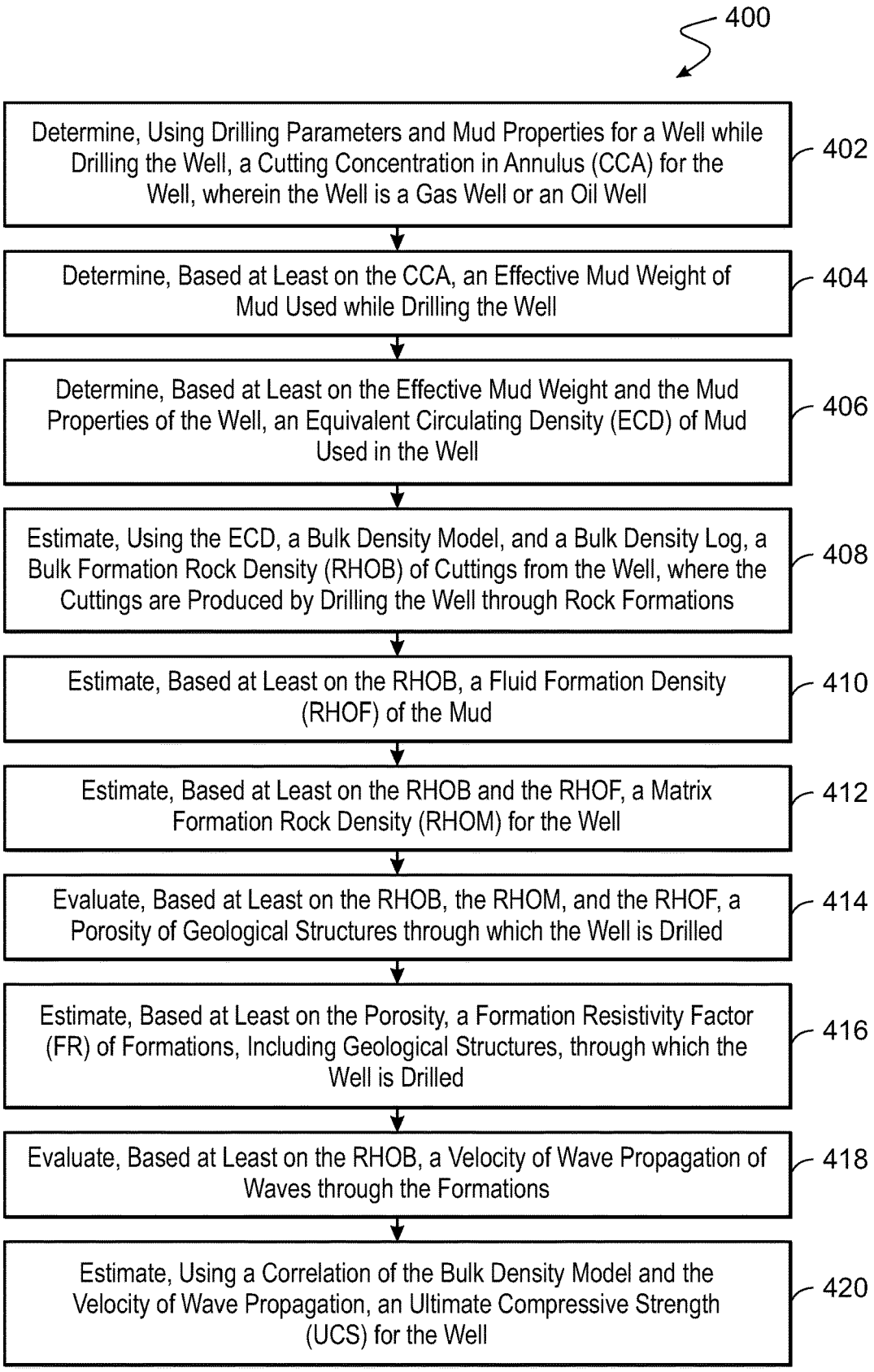
FIG. 4 is a flowchart of an example of a method for estimating ultimate compressive strength (UCS) for a well, according to some implementations of the present disclosure.

FIG. 4 is a flowchart of an example of a method 400 for estimating ultimate compressive strength (UCS) for a well, according to some implementations of the present disclosure. For clarity of presentation, the description that follows generally describes method 400 in the context of the other figures in this description. However, it will be understood that method 400 can be performed, for example, by any suitable system, environment, software, and hardware, or a combination of systems, environments, software, and hardware, as appropriate. In some implementations, various steps of method 400 can be run in parallel, in combination, in loops, or in any order.

At 402, a cutting concentration in annulus (CCA) is determined for a gas or oil well using drilling parameters and mud properties while drilling the well. For example, the drilling parameters can include pumping rate, mud weight, plastic viscosity, and yield point. From 402, method 400 proceeds to 404.

At 404, an effective mud weight of mud used while drilling the well is determined based at least on the CCA. For example, the EMW can be calculated using Equation 1. From 404, method 400 proceeds to 406.

At 406, an equivalent circulating density (ECD) of mud used in the well is determined based at least on the effective mud weight and the mud properties of the well. For example, the ECD can be calculated using Equation 2. From 406, method 400 proceeds to 408.

At 408, a bulk formation rock density (RHOB) of cuttings from the well is estimated using the ECD, a bulk density model, and a bulk density log, where the cuttings are produced by drilling the well through rock formations. For example, the RHOB can be calculated from equations of bulk density and from cuttings concentration in annulus generated while drilling and the remaining percentage from drilled rock. From 408, method 400 proceeds to 410.

At 410, a fluid formation density (RHOF) of the mud is estimated based at least on the RHOB. For example, the RHOF can be calculated using a combination of equations for the modified D exponent factor and bulk density. From 410, method 400 proceeds to 412.

At 412, a matrix formation rock density (RHOM) for the well is estimated based at least on the RHOB and the RHOF. For example, the RHOM can be calculated using the results of determining RHOB and RHOF. From 412, method 400 proceeds to 414.

At 414, a porosity of geological structures through which the well is drilled is evaluated based at least on the RHOB, the RHOM, and the RHOF. For example, the porosity can be calculated using Equation 17. From 414, method 400 proceeds to 416.

At 416, a formation resistivity factor (FR) of formations, including geological structures through which the well is drilled, is estimated based at least on the porosity. For example, the FR can be calculated using Equation 18. From 416, method 400 proceeds to 418.

At 418, a velocity of wave propagation of waves through the formations is evaluated based at least on the RHOB. For example, the velocity can be calculated using Equation 13. From 418, method 400 proceeds to 420.

At 420, an ultimate compressive strength (UCS) is estimated for the well using a correlation of the bulk density model and the velocity of wave propagation. For example, the UCS can be calculated using Equation 14. After 420, method 400 can stop.

In some implementations, method 400 further includes generating the bulk density model configured to determine a bulk formation rock density using an equation including a function of the effective mud weight and the CCA.

In some implementations, method 400 further includes determining formation types and lithology using grain density and matrix density. For example, determining the formation types and lithology can include generating user interface displays of depth-related information and graphs associated with drilling parameters and information described with reference to FIG. 2.

In some implementations, method 400 further includes generating, using at least the UCS for the well and the velocity of wave propagation of waves through the formations of the well, real-time profiles while drilling the well. For example, the real-time profiles can include generating user interface displays of depth-related information and graphs associated with drilling parameters and information described with reference to FIG. 2.

In some implementations, method 400 further includes optimizing, using at least the UCS for the well and the velocity of wave propagation of waves through the formations of the well, mechanical drilling parameters used while drilling the well. For example, optimizing the mechanical drilling parameters used while drilling the well can include optimizing weight on bit (WOB), gallons per minute (GPM), torque on bit, standpipe pressure (SPP), and rheological chemical and physical drilling fluids properties.

In some implementations, in addition to (or in combination with) any previously-described features, techniques of the present disclosure can include the following. Outputs of the techniques of the present disclosure can be performed before, during, or in combination with wellbore operations, such as to provide inputs to change the settings or parameters of equipment used for drilling. Examples of wellbore operations include forming/drilling a wellbore, hydraulic fracturing, and producing through the wellbore, to name a few. The wellbore operations can be triggered or controlled, for example, by outputs of the methods of the present disclosure. In some implementations, customized user interfaces can present intermediate or final results of the above described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or "app"), or at a central processing facility. The presented information can include suggestions, such as suggested changes in parameters or processing inputs, that the user can select to implement improvements in a production environment, such as in the exploration, production, and/or testing of petrochemical processes or facilities. For example, the suggestions can include parameters that, when selected by the user, can cause a change to, or an improvement in, drilling parameters (including drill bit speed and direction) or overall production of a gas or oil well. The suggestions, when implemented by the user, can improve the speed and accuracy of calculations, streamline processes, improve models, and solve problems related to efficiency, performance, safety, reliability, costs, downtime, and the need for human interaction. In some implementations, the suggestions can be implemented in real-time, such as to provide an immediate or near-immediate change in operations or in a model. The term real-time can correspond, for example, to events that occur within a specified period of time, such as within one minute or within one second. Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 5:
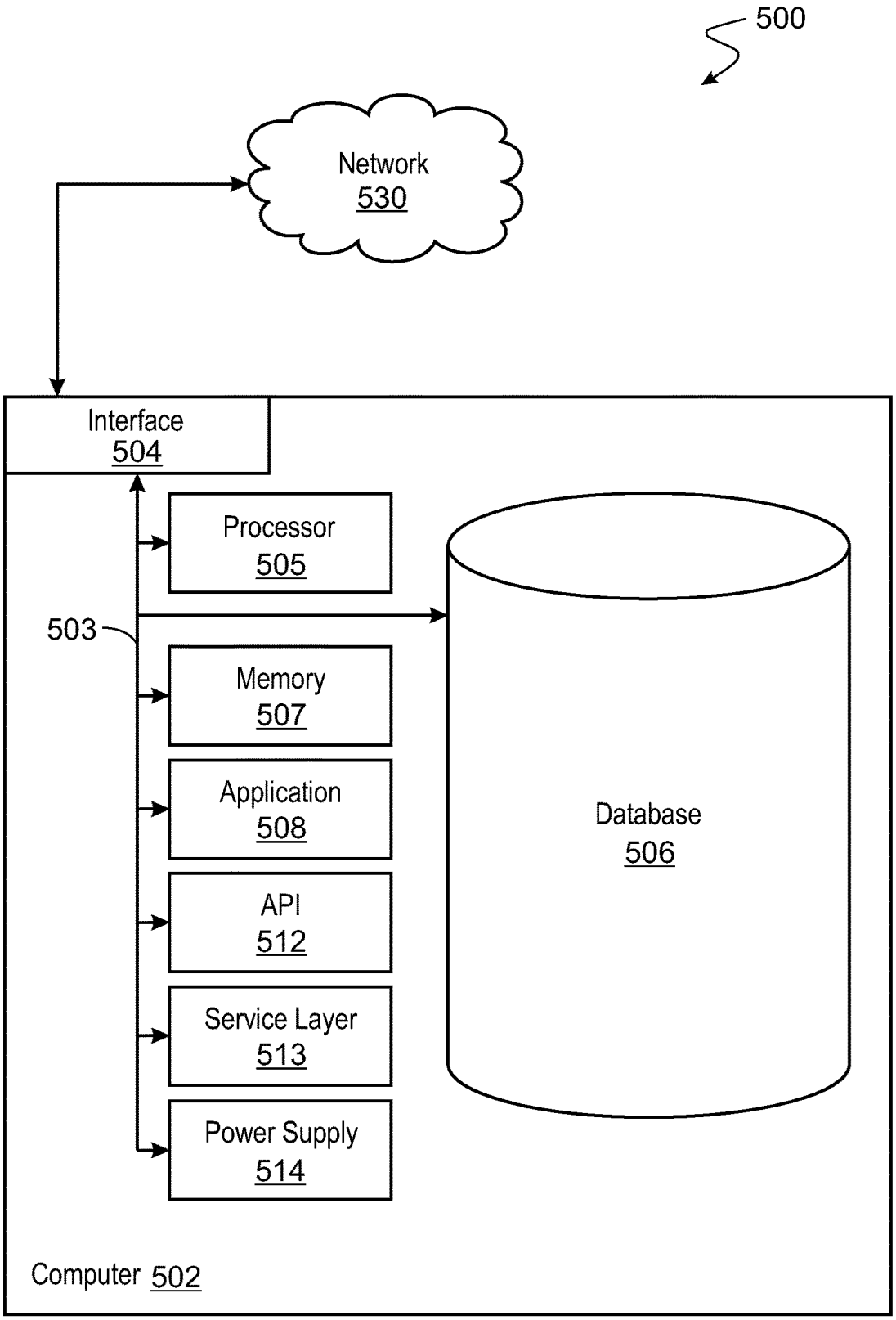
FIG. 5 is a block diagram illustrating an example computer system used to provide computational functionalities associated with described algorithms, methods, functions, processes, flows, and procedures as described in the present disclosure, according to some implementations of the present disclosure.

FIG. 5 is a block diagram of an example computer system 500 used to provide computational functionalities associated with described algorithms, methods, functions, processes, flows, and procedures described in the present disclosure, according to some implementations of the present disclosure. The illustrated computer 502 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a top level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers.

Each of the components of the computer 502 can communicate using a system bus 503. In some implementations, any or all of the components of the computer 502, including hardware or software components, can interface with each other or the interface 504 (or a combination of both) over the system bus 503. Interfaces can use an application programming interface (API) 512, a service layer 513, or a combination of the API 512 and service layer 513. The API 512 can include specifications for routines, data structures, and object classes. The API 512 can be either computer-language independent or dependent. The API 512 can refer to a complete interface, a single function, or a set of APIs.

The service layer 513 can provide software services to the computer 502 and other components (whether illustrated or not) that are communicably coupled to the computer 502. The functionality of the computer 502 can be accessible for all service consumers using this service layer. Software services, such as those provided by the service layer 513, can provide reusable, defined functionalities through a defined interface. For example, the interface can be software written in JAVA, C++, or a language providing data in extensible markup language (XML) format. While illustrated as an integrated component of the computer 502, in alternative implementations, the API 512 or the service layer 513 can be stand-alone components in relation to other components of the computer 502 and other components communicably coupled to the computer 502. Moreover, any or all parts of the API 512 or the service layer 513 can be implemented as child or sub-modules of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 also includes a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

The application 508 can be an algorithmic software engine providing functionality according to particular needs, desires, or particular implementations of the computer 502 and the described functionality. For example, application 508 can serve as one or more components, modules, or applications. Further, although illustrated as a single application 508, the application 508 can be implemented as multiple applications 508 on the computer 502. In addition, although illustrated as internal to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power supply 514 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Described implementations of the subject matter can include one or more features, alone or in combination.

For example, in a first implementation, a computer-implemented method includes the following. A cutting concentration in annulus (CCA) is determined for a gas or oil well using drilling parameters and mud properties while drilling the well. An effective mud weight of mud used while drilling the well is determined based at least on the CCA. An equivalent circulating density (ECD) of mud used in the well is determined based at least on the effective mud weight and the mud properties of the well. A bulk formation rock density (RHOB) of cuttings from the well is estimated using the ECD, a bulk density model, and a bulk density log, where the cuttings are produced by drilling the well through rock formations. A fluid formation density (RHOF) of the mud is estimated based at least on the RHOB. A matrix formation rock density (RHOM) for the well is estimated based at least on the RHOB and the RHOF. A porosity of geological structures through which the well is drilled is evaluated based at least on the RHOB, the RHOM, and the RHOF. A formation resistivity factor (FR) of formations, including geological structures through which the well is drilled, is estimated based at least on the porosity. A velocity of wave propagation of waves through the formations is evaluated based at least on the RHOB. An ultimate compressive strength (UCS) is estimated for the well using a correlation of the bulk density model and the velocity of wave propagation.

The foregoing and other described implementations can each, optionally, include one or more of the following features:

A first feature, combinable with any of the following features, the method further including generating the bulk density model configured to determine a bulk formation rock density using an equation including a function of the effective mud weight and the CCA.

A second feature, combinable with any of the previous or following features, where the drilling parameters include pumping rate, mud weight, plastic viscosity, and yield point.

A third feature, combinable with any of the previous or following features, the method further including determining formation types and lithology using grain density and matrix density.

A fourth feature, combinable with any of the previous or following features, the method further including generating, using at least the UCS for the well and the velocity of wave propagation of waves through the formations of the well, real-time profiles while drilling the well.

A fifth feature, combinable with any of the previous or following features, the method further including optimizing, using at least the UCS for the well and the velocity of wave propagation of waves through the formations of the well, mechanical drilling parameters used while drilling the well.

A sixth feature, combinable with any of the previous or following features, where optimizing the mechanical drilling parameters used while drilling the well, include optimizing weight on bit (WOB), gallons per minute (GPM), torque on bit, standpipe pressure (SPP), and rheological chemical and physical drilling fluids properties.

In a second implementation, a non-transitory, computer-readable medium stores one or more instructions executable by a computer system to perform operations including the following. A cutting concentration in annulus (CCA) is determined for a gas or oil well using drilling parameters and mud properties while drilling the well. An effective mud weight of mud used while drilling the well is determined based at least on the CCA. An equivalent circulating density (ECD) of mud used in the well is determined based at least on the effective mud weight and the mud properties of the well. A bulk formation rock density (RHOB) of cuttings from the well is estimated using the ECD, a bulk density model, and a bulk density log, where the cuttings are produced by drilling the well through rock formations. A fluid formation density (RHOF) of the mud is estimated based at least on the RHOB. A matrix formation rock density (RHOM) for the well is estimated based at least on the RHOB and the RHOF. A porosity of geological structures through which the well is drilled is evaluated based at least on the RHOB, the RHOM, and the RHOF. A formation resistivity factor (FR) of formations, including geological structures through which the well is drilled, is estimated based at least on the porosity. A velocity of wave propagation of waves through the formations is evaluated based at least on the RHOB. An ultimate compressive strength (UCS) is estimated for the well using a correlation of the bulk density model and the velocity of wave propagation.

The foregoing and other described implementations can each, optionally, include one or more of the following features:

A first feature, combinable with any of the following features, the operations further including generating the bulk density model configured to determine a bulk formation rock density using an equation including a function of the effective mud weight and the CCA.

A second feature, combinable with any of the previous or following features, where the drilling parameters include pumping rate, mud weight, plastic viscosity, and yield point.

A third feature, combinable with any of the previous or following features, the operations further including determining formation types and lithology using grain density and matrix density.

A fourth feature, combinable with any of the previous or following features, the operations further including generating, using at least the UCS for the well and the velocity of wave propagation of waves through the formations of the well, real-time profiles while drilling the well.

A fifth feature, combinable with any of the previous or following features, the operations further including optimizing, using at least the UCS for the well and the velocity of wave propagation of waves through the formations of the well, mechanical drilling parameters used while drilling the well.

A sixth feature, combinable with any of the previous or following features, where optimizing the mechanical drilling parameters used while drilling the well, include optimizing weight on bit (WOB), gallons per minute (GPM), torque on bit, standpipe pressure (SPP), and rheological chemical and physical drilling fluids properties.

In a third implementation, a computer-implemented system includes one or more processors and a non-transitory computer-readable storage medium coupled to the one or more processors and storing programming instructions for execution by the one or more processors. The programming instructions instruct the one or more processors to perform operations including the following. A cutting concentration in annulus (CCA) is determined for a gas or oil well using drilling parameters and mud properties while drilling the well. An effective mud weight of mud used while drilling the well is determined based at least on the CCA. An equivalent circulating density (ECD) of mud used in the well is determined based at least on the effective mud weight and the mud properties of the well. A bulk formation rock density (RHOB) of cuttings from the well is estimated using the ECD, a bulk density model, and a bulk density log, where the cuttings are produced by drilling the well through rock formations. A fluid formation density (RHOF) of the mud is estimated based at least on the RHOB. A matrix formation rock density (RHOM) for the well is estimated based at least on the RHOB and the RHOF. A porosity of geological structures through which the well is drilled is evaluated based at least on the RHOB, the RHOM, and the RHOF. A formation resistivity factor (FR) of formations, including geological structures through which the well is drilled, is estimated based at least on the porosity. A velocity of wave propagation of waves through the formations is evaluated based at least on the RHOB. An ultimate compressive strength (UCS) is estimated for the well using a correlation of the bulk density model and the velocity of wave propagation.

The foregoing and other described implementations can each, optionally, include one or more of the following features:

A first feature, combinable with any of the following features, the operations further including generating the bulk density model configured to determine a bulk formation rock density using an equation including a function of the effective mud weight and the CCA.

A second feature, combinable with any of the previous or following features, where the drilling parameters include pumping rate, mud weight, plastic viscosity, and yield point.

A third feature, combinable with any of the previous or following features, the operations further including determining formation types and lithology using grain density and matrix density.

A fourth feature, combinable with any of the previous or following features, the operations further including generating, using at least the UCS for the well and the velocity of wave propagation of waves through the formations of the well, real-time profiles while drilling the well.

A fifth feature, combinable with any of the previous or following features, the operations further including optimizing, using at least the UCS for the well and the velocity of wave propagation of waves through the formations of the well, mechanical drilling parameters used while drilling the well.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at the application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A computer-implemented method, comprising:

determining, using drilling parameters and mud properties for a well while drilling the well, a cutting concentration in annulus (CCA) for the well, wherein the well is a gas well or an oil well;

determining, based at least on the CCA, an effective mud weight of mud used while drilling the well;

determining, based at least on the effective mud weight and the mud properties of the well, an equivalent circulating density (ECD) of mud used in the well;

estimating, using the ECD, a bulk density model, and a bulk density log, a bulk formation rock density (RHOB) of cuttings from the well, wherein the cuttings are produced by drilling the well through rock formations;

estimating, based at least on the RHOB, a fluid formation density (RHOF) of the mud;

estimating, based at least on the RHOB and the RHOF, a matrix formation rock density (RHOM) for the well;

evaluating, based at least on the RHOB, the RHOM, and the RHOF, a porosity of geological structures through which the well is drilled;

estimating, based at least on the porosity, a formation resistivity factor (FR) of formations, including geological structures, through which the well is drilled;

evaluating, based at least on the RHOB, a velocity of wave propagation of waves through the formations;

estimating, using a correlation of the bulk density model and the velocity of wave propagation, an ultimate compressive strength (UCS) for the well; and controlling a downhole equipment using the UCS for the well during wellbore operations, by adjusting drilling parameters comprising a drill bit speed and a drill bit direction, the wellbore operations comprising forming the well.

2. The computer-implemented method of claim 1, further comprising:

generating the bulk density model configured to determine a bulk formation rock density using an equation including a function of the effective mud weight and the CCA.

3. The computer-implemented method of claim 1, wherein the drilling parameters include pumping rate, mud weight, plastic viscosity, and yield point.

4. The computer-implemented method of claim 1, further comprising:

determining formation types and lithology using grain density and matrix density.

5. The computer-implemented method of claim 1, further comprising:

generating, using at least the UCS for the well and the velocity of wave propagation of waves through the formations of the well, real-time profiles while drilling the well.

6. The computer-implemented method of claim 1, further comprising:

optimizing, using at least the UCS for the well and the velocity of wave propagation of waves through the formations of the well, mechanical drilling parameters used while drilling the well.

7. The computer-implemented method of claim 6, wherein optimizing the mechanical drilling parameters used while drilling the well, include optimizing weight on bit (WOB), gallons per minute (GPM), torque on bit, standpipe pressure (SPP), and rheological chemical and physical drilling fluids properties.

8. A non-transitory, computer-readable medium storing one or more instructions executable by a computer system to perform operations comprising:

determining, using drilling parameters and mud properties for a well while drilling the well, a cutting concentration in annulus (CCA) for the well, wherein the well is a gas well or an oil well;

determining, based at least on the CCA, an effective mud weight of mud used while drilling the well;

determining, based at least on the effective mud weight and the mud properties of the well, an equivalent circulating density (ECD) of mud used in the well;

estimating, using the ECD, a bulk density model, and a bulk density log, a bulk formation rock density (RHOB) of cuttings from the well, wherein the cuttings are produced by drilling the well through rock formations;

estimating, based at least on the RHOB, a fluid formation density (RHOF) of the mud;

estimating, based at least on the RHOB and the RHOF, a matrix formation rock density (RHOM) for the well;

evaluating, based at least on the RHOB, the RHOM, and the RHOF, a porosity of geological structures through which the well is drilled;

estimating, based at least on the porosity, a formation resistivity factor (FR) of formations, including geological structures, through which the well is drilled;

evaluating, based at least on the RHOB, a velocity of wave propagation of waves through the formations;

estimating, using a correlation of the bulk density model and the velocity of wave propagation, an ultimate compressive strength (UCS) for the well; and controlling a downhole equipment using the UCS for the well during wellbore operations, by adjusting drilling parameters comprising a drill bit speed and a drill bit direction, the wellbore operations comprising forming the well.

9. The non-transitory, computer-readable medium of claim 8, the operations further comprising:

generating the bulk density model configured to determine a bulk formation rock density using an equation including a function of the effective mud weight and the CCA.

10. The non-transitory, computer-readable medium of claim 8, wherein the drilling parameters include pumping rate, mud weight, plastic viscosity, and yield point.

11. The non-transitory, computer-readable medium of claim 8, the operations further comprising:

determining formation types and lithology using grain density and matrix density.

12. The non-transitory, computer-readable medium of claim 8, the operations further comprising:

generating, using at least the UCS for the well and the velocity of wave propagation of waves through the formations of the well, real-time profiles while drilling the well.

13. The non-transitory, computer-readable medium of claim 8, the operations further comprising:

optimizing, using at least the UCS for the well and the velocity of wave propagation of waves through the formations of the well, mechanical drilling parameters used while drilling the well.

14. The non-transitory, computer-readable medium of claim 13, wherein optimizing the mechanical drilling parameters used while drilling the well, include optimizing weight on bit (WOB), gallons per minute (GPM), torque on bit, standpipe pressure (SPP), and rheological chemical and physical drilling fluids properties.

15. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

determining, using drilling parameters and mud properties for a well while drilling the well, a cutting concentration in annulus (CCA) for the well, wherein the well is a gas well or an oil well;

determining, based at least on the CCA, an effective mud weight of mud used while drilling the well;

determining, based at least on the effective mud weight and the mud properties of the well, an equivalent circulating density (ECD) of mud used in the well;

estimating, using the ECD, a bulk density model, and a bulk density log, a bulk formation rock density (RHOB) of cuttings from the well, wherein the cuttings are produced by drilling the well through rock formations;

estimating, based at least on the RHOB, a fluid formation density (RHOF) of the mud;

estimating, based at least on the RHOB and the RHOF, a matrix formation rock density (RHOM) for the well;

evaluating, based at least on the RHOB, the RHOM, and the RHOF, a porosity of geological structures through which the well is drilled;

estimating, based at least on the porosity, a formation resistivity factor (FR) of formations, including geological structures, through which the well is drilled;

evaluating, based at least on the RHOB, a velocity of wave propagation of waves through the formations;

estimating, using a correlation of the bulk density model and the velocity of wave propagation, an ultimate compressive strength (UCS) for the well; and controlling a downhole equipment using the UCS for the well during wellbore operations, by adjusting drilling parameters comprising a drill bit speed and a drill bit direction, the wellbore operations comprising forming the well.

16. The computer-implemented system of claim 15, the operations further comprising:

generating the bulk density model configured to determine a bulk formation rock density using an equation including a function of the effective mud weight and the CCA.

17. The computer-implemented system of claim 15, wherein the drilling parameters include pumping rate, mud weight, plastic viscosity, and yield point.

18. The computer-implemented system of claim 15, the operations further comprising:

determining formation types and lithology using grain density and matrix density.

19. The computer-implemented system of claim 15, the operations further comprising:

generating, using at least the UCS for the well and the velocity of wave propagation of waves through the formations of the well, real-time profiles while drilling the well.

20. The computer-implemented system of claim 15, the operations further comprising:

optimizing, using at least the UCS for the well and the velocity of wave propagation of waves through the formations of the well, mechanical drilling parameters used while drilling the well.

* * * * *